United States Patent [19]

Lewis

[11] Patent Number: 4,946,109

[45] Date of Patent: Aug. 7, 1990

[54] TOOTH ASSEMBLY FOR ROTARY GRINDING APPARATUS

[75] Inventor: Herbert H. Lewis, Jacksonville Beach, Fla.

[73] Assignee: Newman Machine Company, Inc., Greensboro, N.C.

[21] Appl. No.: 391,466

[22] Filed: Aug. 9, 1989

[51] Int. Cl.[5] ..... B02C 13/09

[52] U.S. Cl. ..... 241/189 R; 241/192; 241/197

[58] Field of Search ..... 241/191, 192, 195, 197, 241/189 R, 189 A

[56] References Cited

U.S. PATENT DOCUMENTS 3,455,517 7/1969 Gilbert ..... 241/195 X

FOREIGN PATENT DOCUMENTS 661608 4/1963 Canada ..... 241/195

*Primary Examiner*—Timothy V. Eley

*Attorney, Agent, or Firm*—Bell, Seltzer, Park & Gibson

[57] ABSTRACT

Tooth assemblies upon the breaker rings of the rotor of the apparatus each include tooth and seat components having abutting surfaces that prevent forward, rearward, inward and lateral movement of the tooth relative to the seat and rotor. Outward tooth movement during operation of the apparatus is prevented by a pin that extends generally parallel to the rotor axis through aligned bores within the tooth and its seat. The pin is shielded from damaging impacts with the material being ground and from detrimental bending stresses, and is releasably retained within the bores by a detent that permits convenient removal of the pin when replacement or repair of the tooth is required.

21 Claims, 1 Drawing Sheet

10
12
14
16
18
20
22
24
26
28
30
32
34
36
38
40
41
42
44
46
47
48
50
52
54
56
58
60
61
62
64
66
68

TOOTH ASSEMBLY FOR ROTARY GRINDING APPARATUS

FIELD OF THE INVENTION

This invention relates to apparatuses for grinding or similarly pulverizing scrap wood, leather or other material. The invention more specifically relates to an improved cutter tooth assembly for a grinding apparatus of the type including a stationary anvil or breaker bar and an associated rotor having a plurality of breaker rings carrying replaceable cutter teeth which during operation of the apparatus move along circular paths of travel that extend adjacent the stationary breaker bar.

BACKGROUND OF THE INVENTION

The teeth upon the rotor breaker rings of a grinding apparatus of the above-described type are customarily secured in place by threaded bolts that extend generally parallel to the direction of rotation of the rotor and that have polygonal heads which are exposed during operation of the apparatus to damaging engagement with the material being ground. Additionally, the bolts are subjected to bending stresses when lateral forces are imposed upon the teeth secured thereby. Due to the environment within which they operate, the rotor teeth become worn or damaged during use, and must be periodically removed for purposes of repair or replacement. When the tooth-securing bolts have become deformed during use of the apparatus, removal of them and of the teeth can be quite tedious and time-consuming. This increases the amount of undesirable "down time" of the apparatus, and thus its operating cost.

SUMMARY OF THE INVENTION

The present invention provides, in a rotary grinder of the above-described type that includes a rotor having breaker rings upon which teeth are fixedly but removably secured, improved tooth assemblies upon at least the larger diameter portions of the breaker rings. Each tooth assembly includes a tooth member, and a complementary tooth seat upon the breaker ring with which the tooth is associated. Each tooth member is of generally saddle-like shape, having an outermost main body section from which laterally spaced leg-like sections depend. When the tooth member is seated upon its associated seat, abutting surfaces upon the seat and the tooth member prevent movement of the tooth member relative to the seat in a lateral direction, i.e., in a direction generally parallel to the central axis of the rotor of the apparatus, and also in an inward, forward or rearward direction. Aligned openings extend through each tooth and its seat generally parallel to the rotor axis, and receive a pin member which when in place prevents the tooth from being moved radially outwardly by centrifugal force from its seat upon the breaker ring. The pin member preferably is totally enclosed by the openings. Since it is shielded to a large extent from damaging impacts with the material being ground, and is not subjected to large magnitude bending stresses, the pin can be easily and quickly removed when tooth replacement or repair becomes necessary. To prevent possible inadvertent displacement of the pin member from the openings during use of the apparatus, it preferably is engaged by a spring-biased detent carried by the seat and engaging a medial section of the pin member.

DESCRIPTION OF THE PRIOR ART

U.S. Pat. No. 3,642,214 discloses a grinding apparatus rotor assembly having breaker rings to which teeth are secured by threaded bolts that extend generally tangentially to the periphery of the rings and that have exposed head portions. Forces upon the sides of the teeth are resisted only by the bolts and associated components (boss and socket) located rearwardly of the teeth and their holders.

U.S. Pat. No. 3,455,517 discloses a rotary crusher having hammers or teeth that are secured upon the rotor rings primarily by bolts that extend generally tangentially of the rings. As in indicated in the patent, such bolts are subjected to damaging forces which may cause their complete failure. In order that the teeth or hammers might be retained upon the rotor even if all of the retaining bolts should fail, each is additionally secured in place by a wedge assembly that includes a bolt which extends generally parallel to the rotor axis through laterally spaced eyes provided upon the tooth or hammer and upon the rotor.

Other U.S. patents of possible interest relative to the present invention are U.S. Pat. Nos. 4,590,978, 4,394,983, 4,162,770, 3,685,265, 3,645,459, 3,473,742, 3,447,758, 3,151,816 and 2,869,793.

DESCRIPTION OF THE DRAWINGS

A preferred embodiment of the invention is illustrated in the accompanying drawings, in which.

DESCRIPTION OF THE PREFERRED EMBODIMENT

Figures 1, 2, 3, 4:
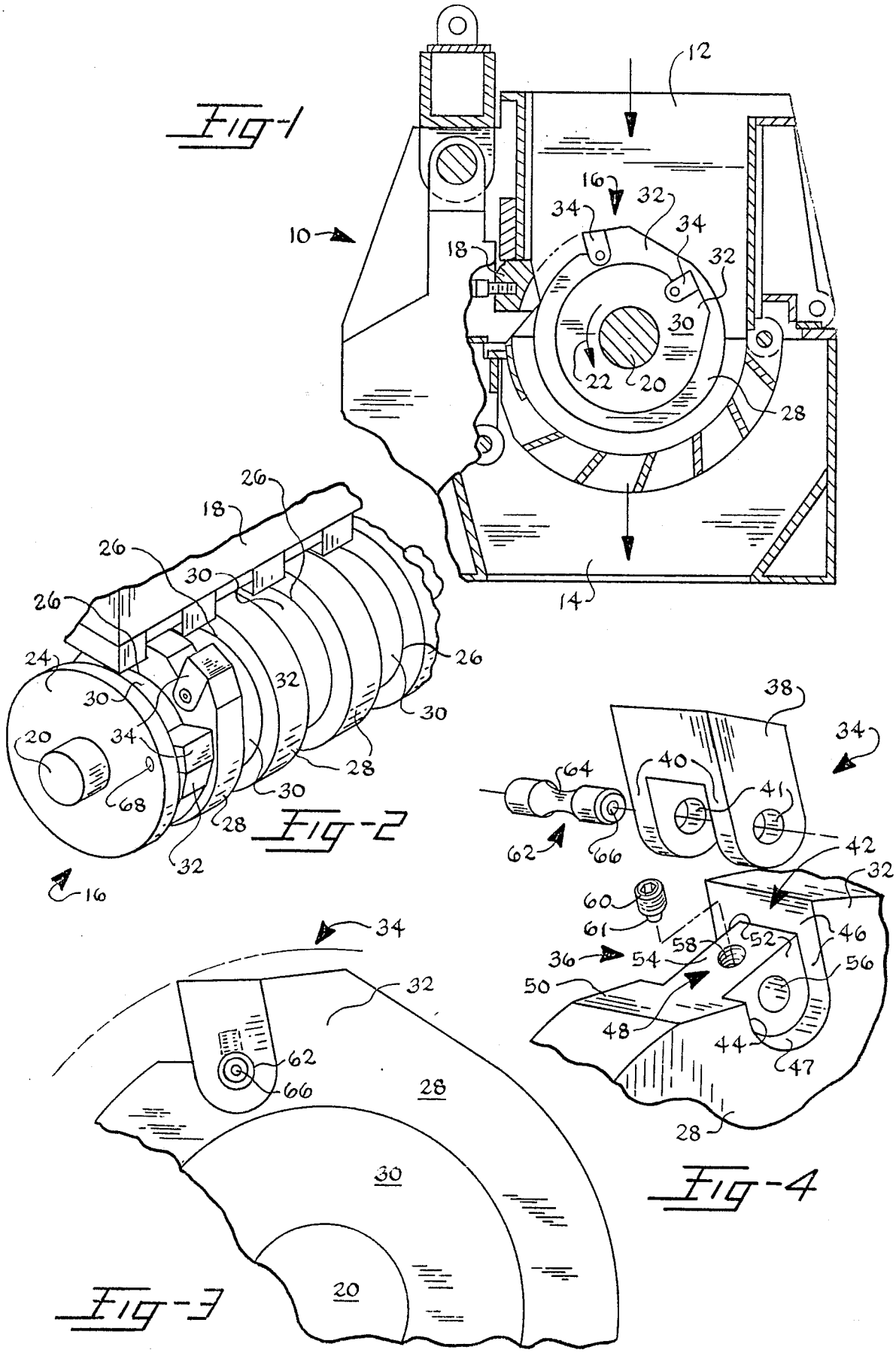
FIG. 1 is a fragmentary view, partially in vertical section and partially in elevation, of a rotary grinding apparatus having a rotor possessing tooth assemblies in accordance with, the invention.
FIG. 2 is a fragmentary perspective view of the rotor and associated breaker bar of the grinding apparatus of FIG. 1.
FIG. 3. is an enlarged fragmentary side elevational view of that part of a large diameter portion of a breaker ring of the rotor which contains a tooth assembly.
FIG. 4 is an exploded fragmentary enlarged perspective view of the rotor tooth assembly.

The numeral 10 in FIG. 1 designates a grinding apparatus having a material inlet 12 and outlet 14 respectively disposed above and below a rotor assembly 16 with which a stationary anvil or breaker bar 18 is associated.

Rotor 16 includes a center shaft 20 that is mounted by suitable bearings (not shown) for rotative movement in the direction of the arrow 22 about its central axis. Rotation is imparted to the shaft during operation of apparatus 10 by suitable drive means (not shown) connected thereto. Rotor assembly 16 further includes a pair of annular end plates 24, one of which is shown in FIG. 2, and a plurality of intervening annular breaker rings 26. Each ring illustratively is of the type having a large diameter portion 28 and a smaller diameter portion 30. End plates 24 and breaker rings 26 are keyed or otherwise secured to shaft 20 for rotation therewith during operation of apparatus 10. Although only shown in association with the breaker ring 26 adjacent the illustrated end plate 24, each portion 28, 30 of each breaker ring has upon its periphery at least one breaker head 32 and an associated tooth assembly which includes a breaker tooth 34 and associated seat 36 (FIG.

4). As is well known to those skilled in the art, when rotor 16 undergoes rotative movement the teeth 34 move along circular paths of travel that pass closely adjacent breaker bar 18 and grind, cut and/or similarly pulverize scrap material (not shown) disposed between the teeth and the breaker bar.

As is also well known to those skilled in the art, the breaker teeth of an apparatus 10 of the described type become worn and/or broken during use, and therefore require periodic replacement. Tooth replacement is a difficult and time-consuming task when, as has heretofore frequently been the case, the threaded bolts customarily used to secure the teeth to the breaker rings have become deformed during use of the apparatus by their repeated engagement with the material being ground, and/or by severe stresses imposed thereon by movement of the teeth. The present invention provides an improved breaker tooth assembly that is particularly useful in association with the larger diameter portions 28 of breaker rings 26, and if desired also the smaller diameter ring portions 30, and which eliminates the foregoing problem and permits easier and speedier replacement of worn teeth.

Referring now particularly to FIG. 4 of the drawings, the breaker tooth 34 of each tooth assembly includes a radially outermost main body section 38, of generally trapezoidal shape, and a pair of laterally spaced leg-like sections 40 that are fixedly connected to or formed integrally with main body section 38 and that depend from the innermost surface of main body section 38 adjacent opposite sides thereof. The lower ends of leg sections 40 are preferably and illustratively rounded, as shown, and have aligned bores 41 or similar openings extending therethrough. Elsewhere along their length, the width (i.e., the dimension generally parallel to the direction of tooth movement during operation of apparatus 10) of each section 40 preferably and illustratively is the same as the width of main body section 38. At least the front, opposite side and outermost (uppermost as viewed in FIGS. 3 and 4) surfaces of main body section 38 are formed of hardened steel. The hardening of such surfaces may be achieved by their heat treatment during manufacture of tooth 34, in which case the opposite side surfaces of the teeth would normally be co-planar (as shown) with the side surfaces of leg sections 40. Alternatively, the aforesaid surfaces of tooth section 38 may be overlaid by carbide plating or similar hard surfacing material (not shown). In either case the outer (upper) edge of the front surface of tooth section 38 may be and preferably is sharpened so as to cut, as well as pulverize or otherwise disintegrate, the scrap material (not shown) introduced into apparatus 10 during operation thereof.

The seat 36 associated with tooth 34 includes a recess 42 within the outer circumferential surface of portion 28 of breaker ring 26 immediately forwardly of breaker head 32. Recess 42 has front and rear surfaces 44, 46 respectively, and an arcuate bottom surface 47 having a curvature complementary to that of the inner (lower) ends of leg sections 40 of tooth 38. Seat 36 further includes a pad-like section 48 that is located within recess 44 and disposed centrally thereof in a lateral direction, i.e., a direction generally parallel to the central axis of rotor 16. Pad section 48 preferably and illustratively is integral with the front, rear and bottom surfaces of recess 42. Each side surface 52 of section 48 extends parallel to the adjacent side surface of breaker ring portion 28 but is inwardly recessed relative to it, preferably by an amount equal to or slightly greater than the thickness of one of the tooth leg sections 40. The rear edge of the upper surface 54 of pad section 48 is disposed below the outer (upper) edge of rear surface 46 of recess 42, and the front edge of pad section 48 merges with the rear edge of a sloping surface 50 provided upon breaker ring portion 28 immediately forwardly of recess 42.

A bore 56 extends laterally through pad section 48 of seat 36. The diameter of bore 56 is the same as the diameter of the aligned bores 41 within the lower portions of leg sections 40 of tooth 34. A threaded bore 58 extending inwardly through surface 54 of pad section 48 communicates at its inner end with the medial portion of bore 56 and receives an externally threaded member 60 having a spring-biased detent element 61 at its inner end.

When tooth 34 is seated upon seat 36, as illustrated in FIG. 3 of the drawings, the inner surface of tooth main body section 38 and the outer (upper as viewed in FIG. 4) surface of pad section 48 of the seat abut throughout their entire extent. Additionally, the arcuate inner end surfaces of leg sections 40 of tooth 34 abut the complementary inner arcuate surface 47 of seat recess 42. This prevents inward movement of tooth 34 relative to seat 36 during operation of apparatus 10. Lateral movement of tooth 34 relative to seat 36 is prevented by abutment of the interior surfaces of tooth leg sections 40 with the coextensive opposite side surfaces of pad section 48 of the seat. Similarly, abutment of the forward and rearward surfaces of the tooth leg sections 40 with the respective front and rear surfaces 44, 46 of recess 42, in conjunction with abutment of the rear surface of tooth section 38 with recess rear surface 46, prevent forward and rearward movement of tooth 34 relative to seat 36 during operation of the breaker apparatus.

Movement of tooth 38 in an outward direction during operation of the apparatus is prevented by a pin element 62 that is received within the then-aligned bores 41, 56 of leg sections 40 of tooth 34 and of pad section 48 of seat 36. The length of pin 60 is such that neither end thereof projects beyond the exterior side surfaces of tooth leg sections 40, and preferably such leg sections themselves are coplanar with or recessed relative to the planes of the adjacent side surfaces of breaker ring portion 28. Pin 62 is releasably retained within bores 41, 56 during operation of apparatus 10 by engagement of detent member 46 with a groove 64 that encircles the middle portion of the pin. At such time as it becomes necessary to replace or repair tooth 34, its removal can be quickly and easily effected after displacing pin 62 axially from bores 41, 56, either by driving the pin therefrom by means of a hammer and punch (not shown), or by pulling the pin from the bores with the assistance of a suitable tool (not shown) adapted to be mated with a threaded or otherwise configured bore 66 extending into pin 62 from one end thereof. The spring (not shown) and movable detent element 61 of detent member 56 of course automatically retract in response to the aforesaid axial movement of pin 62.

The rapidity and ease with which pin 62 can be removed is attributable in large part to the fact that its recessed mounting shields it from many if not all of the impacts, with the material being ground, that the pin might otherwise receive during operation of the apparatus. Additionally, the pin has no threads or similar elements that might be damaged by such impacts. Furthermore, and perhaps most importantly, the abutting surfaces upon tooth 34 and seat 36 resist and prevent forward, rearward, inward and lateral movements of tooth 34 relative to seat 36 during operation of apparatus 10, and thus prevent bending or similar deformation of pin 62 that might be caused by such tooth movement. The only significant stresses imposed upon pins 62 during use of apparatus 10 therefore are those arising from the centrifugal forces that tend to move teeth 34 outwardly during rotation of breaker rings 28, and such stresses are normally insufficient to cause deformation of the pins.

While the present improved tooth assemblies are particularly suited for use upon the large diameter breaker ring portion 28 of an apparatus of the type described, which teeth undergo more rapid movement and therefore tend to require more frequent repair and/or replacement, the assemblies may if desired also be employed upon the smaller diameter breaker ring portions 30. In the latter case bores 68 such as that shown in FIG. 2 may be provided through the rotor end plates and large diameter breaker ring portions 28 to permit insertion and removal of the therewith aligned pins 62 associated with the smaller diameter breaker ring portions 30.

While a preferred embodiment of the invention has been specifically shown and described, this was for purposes of illustration only, and not for purposes of limitation, the scope of the invention being in accordance with the following claims;

I claim:

1. An apparatus for grinding scrap material, comprising:

a casing adapted to receive said material;

a breaker bar member fixedly mounted within said casing;

a rotor assembly mounted within said casing adjacent said breaker bar for rotation about a central axis, said assembly including a plurality of breaker rings concentric with and spaced along the length of said axis, each of said breaker rings having upon its outer periphery a breaker tooth assembly including a tooth member and a tooth seat supporting said tooth member;

said tooth member and said tooth seat each having an opening extending therethrough, said openings being aligned with each other and being generally parallel to said axis;

an elongate pin member located within and shielded by said openings, said pin member releasably retaining said tooth member in association with said seat;

said tooth seat and said tooth member having complementary abutting surfaces preventing forward, rearward, inward and lateral movement of said tooth member relative to said tooth seat and to said pin member; and releasable detent means engaging said pin member intermediate the length thereof for releasably retaining said pin member within said openings.

2. Apparatus as in claim 1, wherein said pin member has an encircling groove intermediate the length thereof, and said detent means includes a detent element biased in a first direction into engagement with said groove of said pin member, and capable of limited movement in a second direction opposite to said first direction.

3. Apparatus as in claim 1, wherein each of said breaker ring has substantially parallel opposite sides, a peripheral portion, and a recess within said peripheral portion; said recess having front, rear, and bottom surfaces; said tooth seat including said recess and a pad-like section disposed within said recess and connected to said surfaces thereof; said pad-like section having opposite side surfaces spaced inwardly from said opposite sides of said breaker ring; said complementary abutting surfaces including said surfaces op said recess and said side surfaces of said pad-like section.

4. Apparatus as in claim 3, wherein said opposite side surfaces of said pad-like section of each of said breaker rings are substantially parallel to each other and to said sides of said breaker ring.

5. Apparatus as in claim 4, wherein said pad-like section of said tooth seat of each of said breaker rings has an outer surface abutting said tooth member, opposing inward movement thereof, and comprising one of said complementary abutting surfaces.

6. Apparatus as in claim 5, wherein said complementary abutting surfaces preventing said forward movement and rearward movement of said tooth member include said front and rear surfaces of said seat.

7. Apparatus as in claim 6, wherein said outer surface of said pad-like section of said tooth seat of each of said breaker rings is disposed centrally of said recess in a lateral direction.

8. Apparatus as in claim 3, wherein said tooth member of each of said breaker rings includes an outer main body section and laterally spaced leg-like sections depending inwardly from opposite sides of said main body section, said leg-like sections of said tooth member abutting and overlying respective opposite side surfaces of said pad-like section of said tooth seat, and said main body section of said tooth member having front and rear surfaces respectively abutting said front and rear surfaces of said recess.

9. Apparatus as in claim 8, wherein said recess is of generally U-shaped configuration, and said bottom surface thereof is of concave curvature.

10. Apparatus as in claim 9, wherein the inner ends of said leg-like sections of said tooth member have a convex curvature complementary to said concave curvature of said bottom surface of said recess.

11. Apparatus as in claim 10, wherein said pad-like section of said tooth seat of each of said breaker rings has an outer surface, and said main body section of said tooth has an inner surface in coextensive abutting relationship with said outer surface of said pad-like section of said tooth seat.

12. An apparatus for grinding scrap material, comprising:

a casing adapted to receive said material;

a breaker bar member fixedly mounted within said casing;

a rotor assembly mounted within said casing adjacent said breaker bar for rotation about a central axis, said assembly including a plurality of breaker rings concentric with and spaced along the length of said axis, each of said breaker rings having upon its outer periphery a breaker tooth assembly including a tooth member and a tooth seat supporting said tooth member;

said tooth member and said tooth seat each having an opening extending therethrough, said openings being aligned with each other and being generally parallel to said axis;

an elongate pin member located within and shielded by said openings, said pin member releasably retaining said tooth member in association with said seat;

said tooth seat and said tooth member having complementary abutting surfaces preventing forward, rearward, inward and lateral movement of said tooth member relative to said tooth seat and to said pin member;

each of said breaker rings further having substantially parallel opposite sides, a peripheral portion, and a recess within said peripheral portion, said recess having front, rear, and bottom surfaces; said tooth seat including said recess and a pad-like section disposed within said recess and connected to said surfaces thereof; said pad-like section having opposite side surfaces spaced inwardly from said opposite sides of said breaker ring; said complementary abutting surfaces including said surfaces of said recess and said side surfaces of said pad-like section.

13. Apparatus as in claim 12, and further including releasable detent means engaging said pin member intermediate the length thereof for releasably retaining said pin member within said openings.

14. Apparatus as in claim 12, wherein said opposite side surfaces of said pad-like section of each of said breaker rings are substantially parallel to each other and to said sides of said breaker ring.

15. Apparatus as in claim 14, wherein said pad-like section of said tooth seat of each of said breaker rings has an outer surface abutting said tooth member, opposing inward movement thereof, and comprising one of said complementary abutting surfaces.

16. Apparatus as in claim 15, wherein said complementary abutting surfaces preventing said forward and rearward movement of said tooth member includes said front and rear surfaces of said seat.

17. Apparatus as in claim 16, wherein said outer surface of said pad-like section of said tooth seat of each of said breaker rings is disposed centrally of said recess in a lateral direction.

18. Apparatus as in claim 12, wherein said tooth member of each of said breaker rings includes an outer main body section and laterally spaced leg-like sections depending inwardly from opposite sides of said main body section, said leg-like sections of said tooth member abutting and overlying respective opposite side surfaces of said pad-like section of said tooth seat, and said main body section of said tooth member having front and rear surfaces respectively abutting said front and rear surfaces of said recess.

19. Apparatus as in claim 18, wherein said recess is of generally U-shaped configuration, and said bottom surface thereof is of concave curvature.

20. Apparatus as in claim 19, wherein the inner ends of said leg-like sections of said tooth member have a convex curvature complementary to said concave curvature of said bottom surface of said recess.

21. Apparatus as in claim 20, wherein said pad-like section of said tooth seat of each of said breaker rings has an outer surface, and said main body section of said tooth member has an inner surface in co-extensive abutting relationship with said outer surface of said pad-like section of said tooth seat.

* * * * *